US011739974B2

(12) United States Patent
Yang

(10) Patent No.: US 11,739,974 B2
(45) Date of Patent: Aug. 29, 2023

(54) GRILL BODY, GRILL, AND AIR PURIFIER

(71) Applicant: SHENZHEN ANTOP TECHNOLOGY CO., LTD, Shenzhen (CN)

(72) Inventor: Ruidian Yang, Shenzhen (CN)

(73) Assignee: SHENZHEN ANTOP TECHNOLOGY CO., LTD, Shenzhen (CN)

( * ) Notice: Subject to any disclaimer, the term of this patent is extended or adjusted under 35 U.S.C. 154(b) by 405 days.

(21) Appl. No.: 17/110,664

(22) Filed: Dec. 3, 2020

(65) Prior Publication Data

US 2022/0057103 A1 Feb. 24, 2022

(30) Foreign Application Priority Data

Aug. 24, 2020 (CN) ..... 202010854492.6

(51) Int. Cl.
*F24F 13/08* (2006.01)
*F24F 3/16* (2021.01)

(52) U.S. Cl.
CPC ..... *F24F 13/082* (2013.01); *F24F 3/16* (2013.01)

(58) Field of Classification Search
CPC ... F24F 13/082; F24F 3/16; F24F 1/40; B01D 45/08
USPC ..... 55/467, 416, 342, 337; 454/242, 309, 454/314, 215
See application file for complete search history.

(56) References Cited

FOREIGN PATENT DOCUMENTS

CN 107990443 A * 5/2018 ..... F24F 1/40

* cited by examiner

*Primary Examiner* — Robert A Hopkins
*Assistant Examiner* — Qianping He
(74) *Attorney, Agent, or Firm* — AVEK IP, LLC; Kent R. Erickson

(57) ABSTRACT

Provided are a grill body, a grill, and an air purifier. The grill body includes a plurality of grill bars, with an air opening or slot between two adjacent grill bars. Each of the grill bars includes a windward face configured to be convex in a middle of the grill bar and gradually sink towards two sides of the grill bar.

13 Claims, 8 Drawing Sheets

GRILL BODY, GRILL, AND AIR PURIFIER

CROSS-REFERENCE TO RELATED APPLICATIONS

This application is based on and claims the benefit of priority from Chinese Patent Application No. 202010854492.6, filed on 24 Aug. 2020, the entirety of which is incorporated by reference herein.

FIELD OF THE INVENTION

The present disclosure relates to the field of air purification, and in particular, to a grill body, a grill, and an air purifier.

BACKGROUND

At present, an air outlet of an air purifier is generally provided with a grill which can prevent debris from entering the air purifier and play roles of structural reinforcement and appearance wrapping. Small air openings in the grill can improve the safety performance of the air purifier, but may cause too wide or too narrow grill bars. When the grill bars are too wide (when there are a small number of grill bars, in order to make the air opening smaller, the grill bars need to be made wider), there is a large contact area between the grill bars and the air flow, which is easy to increase the air-outlet resistance of the air purifier, reduce the efficiency of air purification, and at the same time lead to increased noise. When the grill bars are too narrow (when there are a large number of grill bars, in order to make the air opening smaller, the grill bars need to be made narrower, that is, the grill bars are more densely distributed), the structural strength does not meet the requirements and is further limited by production accuracy. Therefore, how to provide a reduced air-outlet resistance, an improved efficiency of air purification, and reduced noise while ensuring the safety performance of the air purifier is an urgent problem to be solved by those skilled in the art.

SUMMARY

The present disclosure aims at solving at least one of the technical problems in the related technologies. To this end, the present disclosure provides a grill body which can reduce the air-outlet resistance, improve air-outlet efficiency, and reduce air-outlet noise while effectively blocking debris and ensuring its own structural strength.

The present disclosure further provides a grill.

The present disclosure further provides an air purifier.

In a first aspect, an embodiment of the present disclosure provides a grill body including a plurality of grill bars, with an air hole, opening, outlet, slot or gap between two adjacent grill bars. Each of the grill bars includes a windward face configured to be convex in a middle of the grill bar and gradually rise or slope outward and away from the middle of the grill bar towards two sides of the grill bar and in the direction of airflow past the grill bar.

The grill body in the embodiment of the present disclosure has at least the following beneficial effects. The grill body includes a plurality of grill bars, and each of the grill bars includes a windward face configured to be convex in a middle of the grill bar and gradually sink towards two sides of the grill bar. Thus, when the air comes into contact with the grill bar, an airflow changes from blowing directly against the windward face to obliquely flowing along both sides of the windward face, and finally flows out from the air opening. In the whole air-outlet process, there is a small change in a flow direction of the airflow, the resistance of the airflow is small, and the air-outlet efficiency is high. Besides, compared with the traditional planar windward face, the airflow is well guided by the windward face, is not easy to be disturbed and generates low noise. In addition, the present disclosure focuses on improving the shape of the windward face of the grill, and there is no limitation on the width of the grill. Compared with the traditional method of making the grill bar to be thin or making the air opening to be large, the grill body of the present disclosure can not only block debris, but also guarantee its own structural strength.

In some embodiments, the windward face of the grill bar includes a first guide surface and a second guide surface, one side of the first guide surface is connected to one side of the second guide surface, for any axis of the air opening, a plane perpendicular to the axis is defined as a reference plane, an intersecting line between a cross section of the grill bar passing through the axis and the first guide surface is defined as a first intersecting line, an intersecting line between the cross section of the grill bar passing through the axis and the second guide surface is defined as a second intersecting line, an included angle between the first intersecting line and the reference plane is 8° to 15°, and an included angle between the second intersecting line and the reference plane is 15° to 85°.

In some embodiments, both the first guide surface and the second guide surface are planar.

In some embodiments, the grill bar has a streamlined cross section.

In some embodiments, the grill bar includes a leeward face configured to be concave in the middle of the grill bar and gradually rise or slope away from the middle of the grill bar towards the two sides of the grill bar and in the direction of airflow past or around the grill bar.

In some embodiments, the air opening has a width of 1 mm to 4 mm.

In a second aspect, an embodiment of the present disclosure provides a grill, including the grill body described above, and further including an inner positioning member and an outer positioning frame, one end of the grill bar being fixedly connected to the inner positioning member, the other end of the grill bar being fixedly connected to the outer positioning frame, and the plurality of grill bars being radially distributed.

The grill in the embodiment of the present disclosure has at least the following beneficial effects: the grill includes an inner positioning member and an outer positioning frame, so that the grill body can be quickly and conveniently mounted; meanwhile, due to the use of the above grill body, the grill can provide reduced air-outlet resistance, improved air-outlet efficiency, and reduced air-outlet noise, while effectively blocking debris and ensuring its own structural strength.

In some embodiments, the grill bar is configured to gradually bend or curve in a circumferential direction of the outer positioning frame.

In some embodiments, the grill bar is configured to gradually sink from inside to outside in an air-outlet direction.

In a third aspect, an embodiment of the present disclosure provides an air purifier including the grill described above, the grill being disposed at an air outlet and/or an air inlet of the air purifier.

The air purifier in the embodiment of the present disclosure has at least the following beneficial effects: through the use of the above grill, the air-outlet resistance can be reduced, the efficiency of air purification can be improved, and noise can be reduced, thereby helping to improve user experience.

DETAILED DESCRIPTION

The conception of the present disclosure and achieved technical effects are clearly and completely described as below with reference to embodiments, so as to fully understand the objectives, features, and effects of the present disclosure. Obviously, the described embodiments are only a part of, not all of, the embodiments of the present disclosure. All other embodiments obtained by a person skilled in the art based on the embodiments of the present disclosure without creative effort shall fall into the protection scope of the present disclosure.

In the description of the embodiments of the present disclosure, if directional descriptions are involved, for example, directional or positional relationships indicated by "up", "down", "front", "back", "left", "right", etc. are based on the directional or positional relationships shown in the accompanying drawings, they are intended only to facilitate the description of the present disclosure and simplify the description, instead of indicating or implying the apparatus or element referred to must have a particular direction and be constructed and operated in the particular direction a, and thus cannot be construed as limitations on the present disclosure.

In the description of the embodiments of the present disclosure, if a feature is referred to as "disposed on", "fixed to", "connected to", or "mounted to" another feature, it may be directly disposed on, fixed to, or connected to the another feature or indirectly disposed on, fixed to, connected to, or mounted to the another feature. In description of the embodiments of the present disclosure, if "several" is involved, it means more than one; if "a plurality of" is involved, it means more than two; if "greater than", "less than", and "more than" are involved, they should all be understood as not including the number; if "above", "below", and "within" are involved, they should all be understood as including the number. If "first" and "second" are involved, they should be understood as being used to distinguish technical features, but not to indicate or imply relative importance or implicitly indicating the number of indicated technical features or a precedence relationship of the indicated technical features.

Figure 1:
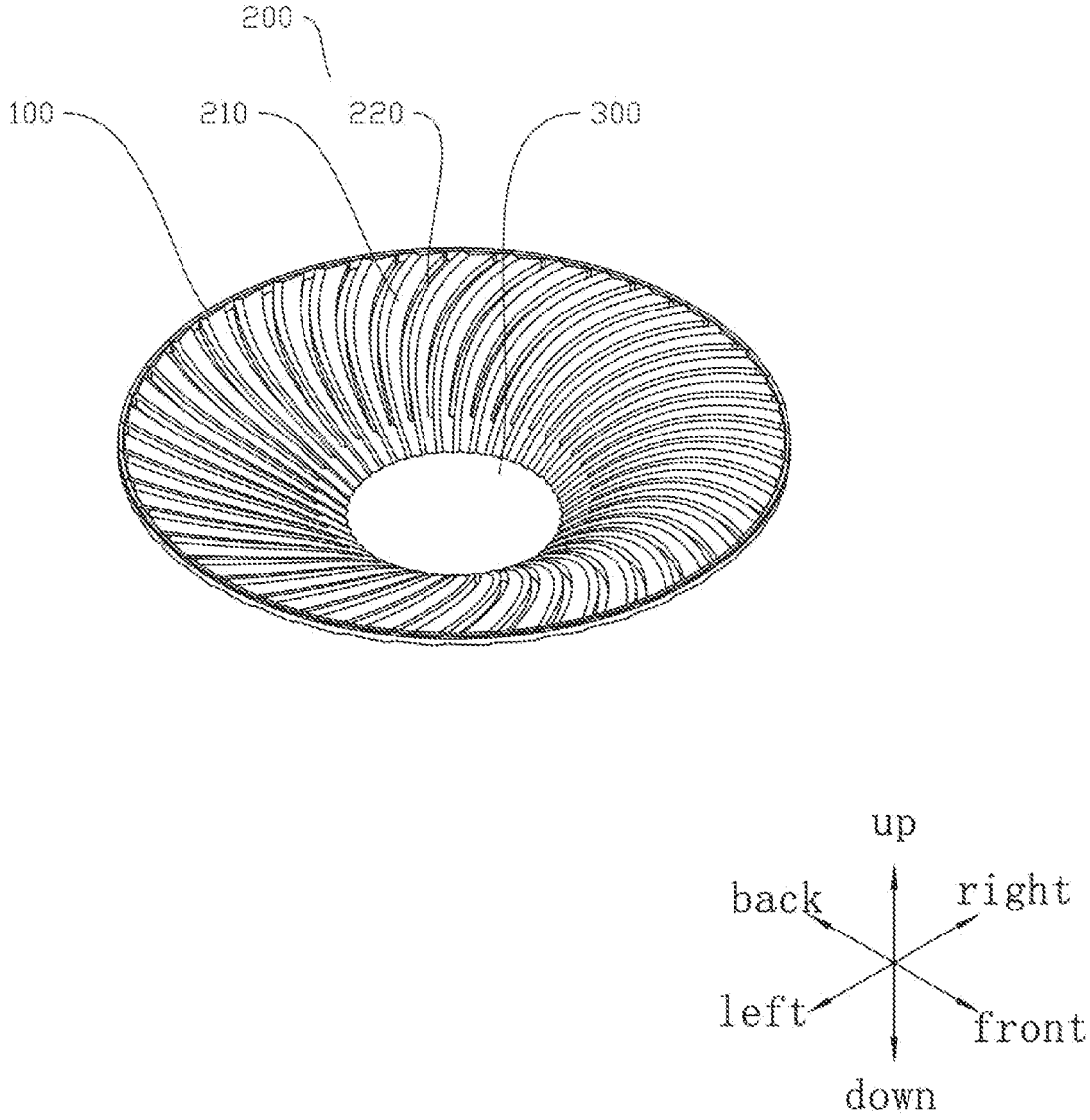
FIG. 1 is an axonometric view of a grill according to a first embodiment.
Figure 2:
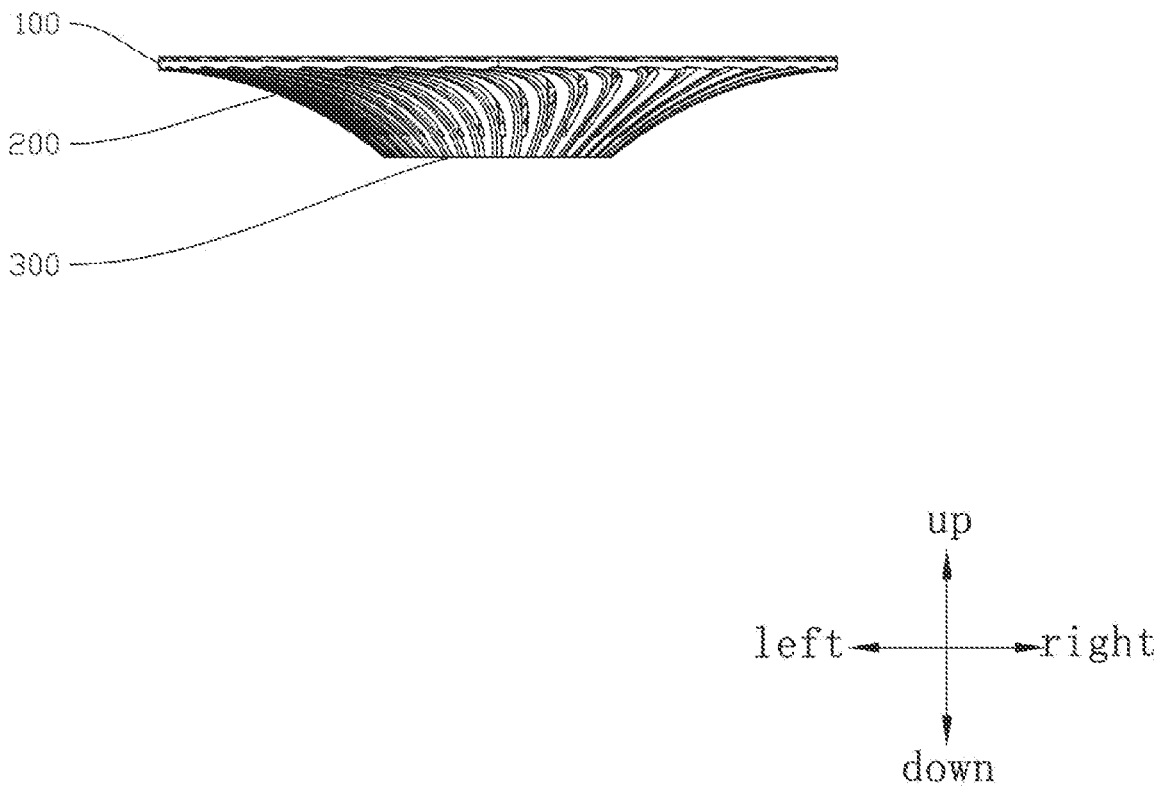
FIG. 2 is a side view of the grill in FIG. 1.

Referring to FIG. 1 and FIG. 2, FIG. 1 is an axonometric view of a grill according to a first embodiment, and FIG. 2 is a side view of the grill in FIG. 1. The grill in this embodiment includes an outer positioning frame 100, a grill body 200, and an inner positioning member 300. The grill body 200 includes a plurality of grill bars 210. One end of each of the grill bars 210 is fixedly connected to the inner positioning member 300, the other end of each of the grill bars 210 is fixedly connected to the outer positioning frame 100, and the inner positioning member 300 and the outer positioning frame 100 function cooperatively to fix the grill bars 210. The plurality of grill bars 210 are radially distributed, and an air opening 220 is provided between two adjacent grill bars 210. The air opening 220 may also, for example, be referred to as an air outlet, gap, slot or hole. Thus, the densely arranged grill bars 210 can block the passage of debris, while the purified air can pass through the air opening 220. A lower side of the grill is an inlet side, and an upper side of the grill is an outlet side, that is, a lower surface of the grill bar 210 is a windward face, and an upper surface of the grill bar 210 is a leeward face.

In this embodiment, the grill is made of a plastic material, such as PE (polyethylene), PP (polypropylene), PVC (polyvinyl chloride), PS (polystyrene), or ABS (styrene resin). The whole grill is formed by injection molding, and the outer positioning frame 100, the grill body 200, and the inner positioning member 300 are integrally formed.

In other embodiments, when the grill is made of aluminum alloy or other metal materials, the grill may also be formed by cast molding.

In other embodiments, the grill may only include the outer positioning frame 100 and the grill body 200 without the inner positioning member 300. In one embodiment, the grill body 200 can be mounted only by the outer positioning frame 100. In this case, both ends of each of the grill bars 210 are fixedly connected to the outer positioning frame 100, and the grill bars 210 are arrayed inside the outer positioning frame 100.

Figure 3:
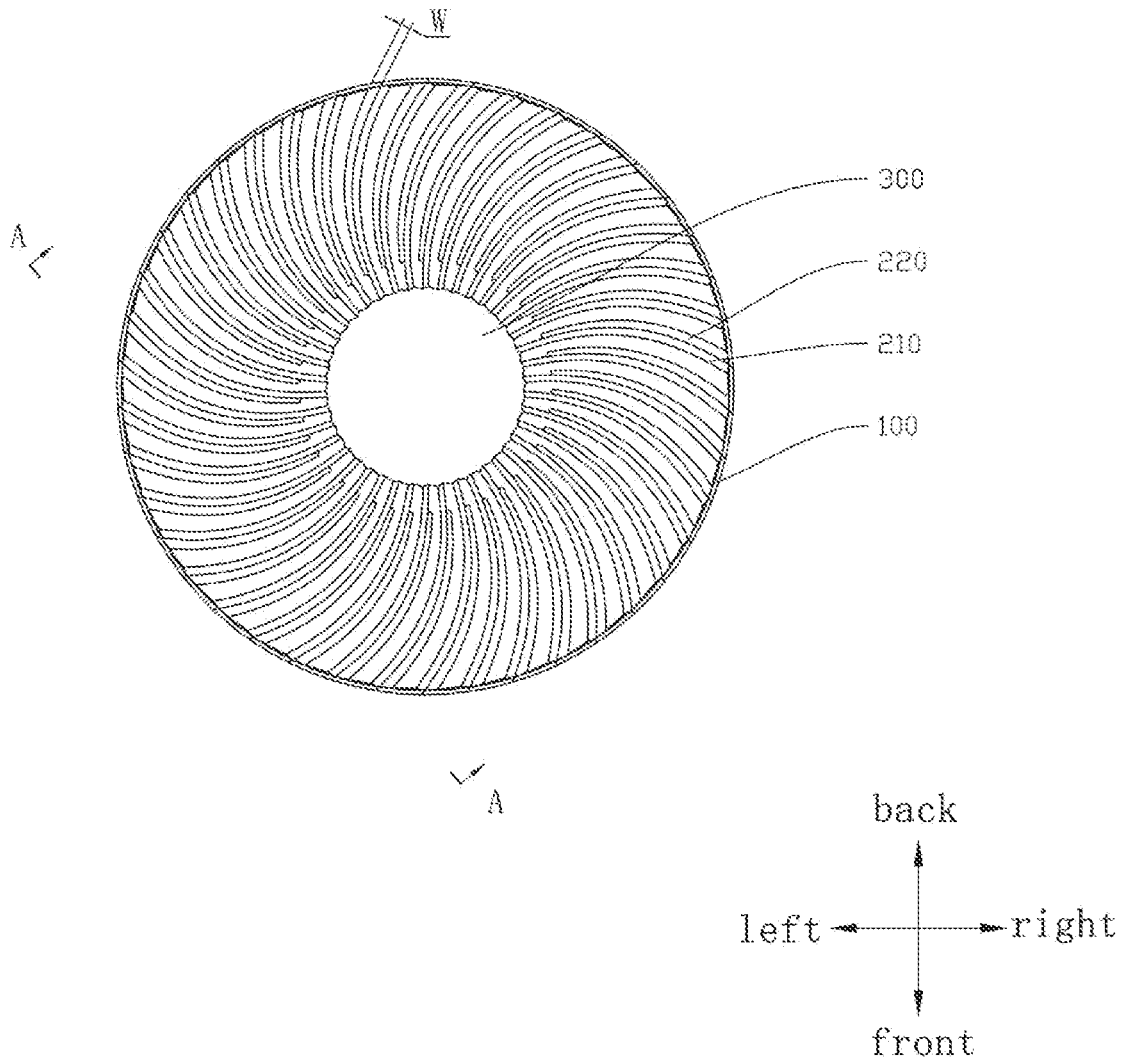
FIG. 3 is a top view of the grill in FIG. 1.
Figure 4:
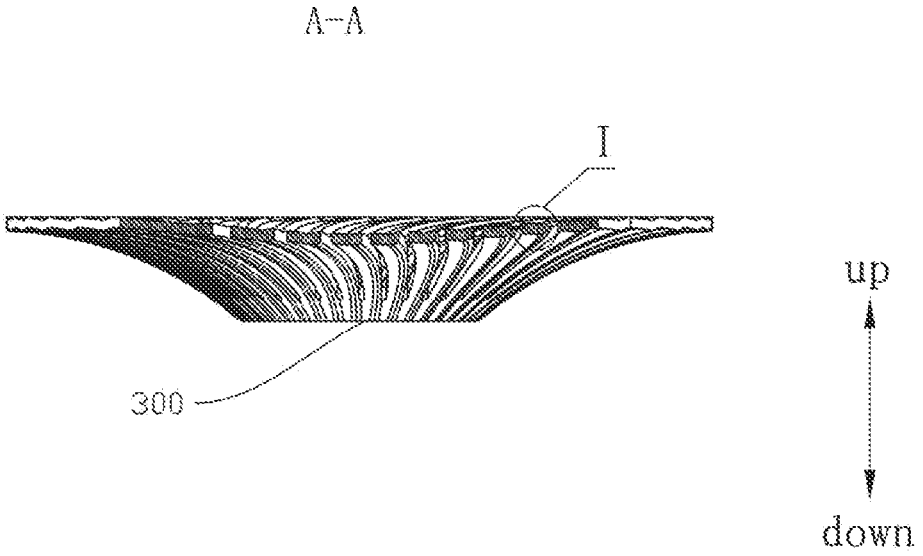
FIG. 4 is a sectional view of the grill in FIG. 3 along an A-A section.
Figure 5:
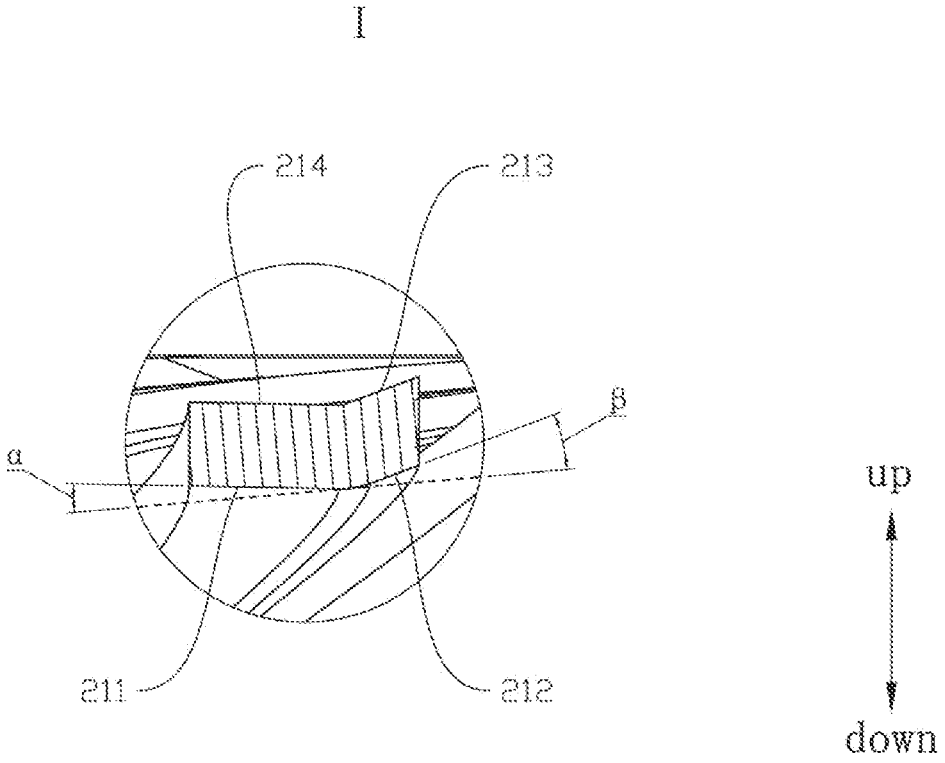
FIG. 5 is an enlarged schematic view of a region I in FIG. 4.

Referring to FIG. 3 to FIG. 5, FIG. 3 is a top view of the grill in FIG. 1, FIG. 4 is a sectional view of the grill in FIG. 3 along an A-A section, and FIG. 5 is an enlarged schematic view of a region I in FIG. 4. In order to ensure that the flow rate of an airflow will not be greatly reduced when the airflow passes through the grill and a small noise is caused by the airflow, the windward face of the grill bar 210 is divided into a first guide surface 211 and a second guide surface 212. One side of the first guide surface 211 is connected to one side of the second guide surface 212, the other side of the first guide surface 211 extends toward the air opening 220 at one side of the grill bar 210, and the other side of the second guide surface 2 extends toward the air opening 220 at the other side of the grill bar 210. A joint between the first guide surface 211 and the second guide surface 212 is a innermost point of the windward face of the grill bar 210 in the direction of airflow around or past the grill bar 210. Both the first guide surface 211 and the second guide surface 212 gradually rise or slope outward and away from the middle of the grill 210 in an air-outlet direction of the grill (i.e. from bottom to top).

In this embodiment, both the first guide surface 211 and the second guide surface 212 are planar, which is convenient for processing and forming. The first guide surface 211 and the second guide surface 212 are joined by a rounded corner, in order to avoid a sharp corner which may affect the appearance and use experience. To define a tilt degree or slope of the first guide surface 211 and the second guide surface 212, for any axis of the air opening 220, a plane perpendicular to the axis is defined as a reference plane (referring to FIG. 5, an intersecting line between the reference plane and the A-A section is shown as a dotted line in FIG. 5). An intersecting line between a cross section (e.g. the A-A section in FIG. 3) of the grill bar 210 passing through the axis and the first guide surface 211 is defined as a first intersecting line, an included angle a is defined between the first intersecting line and the reference plane, which is within the range of $8° \leq \alpha \leq 45°$, and the specific value of $\alpha$ may be 8°, 15°, 30°, 40° or 45° or other values within the range. An intersecting line between the cross section (e.g. the A-A section in FIG. 3) of the grill bar 210 passing through the axis and the second guide surface 212 is defined as a second intersecting line, an included angle $\beta$ is defined between the second intersecting line and the reference plane, which is within the range of $15° \leq \beta \leq 85°$, and the specific value of $\beta$ may be 15°, 30°, 45°, 60° or 85° or other values within the range.

Figure 7:
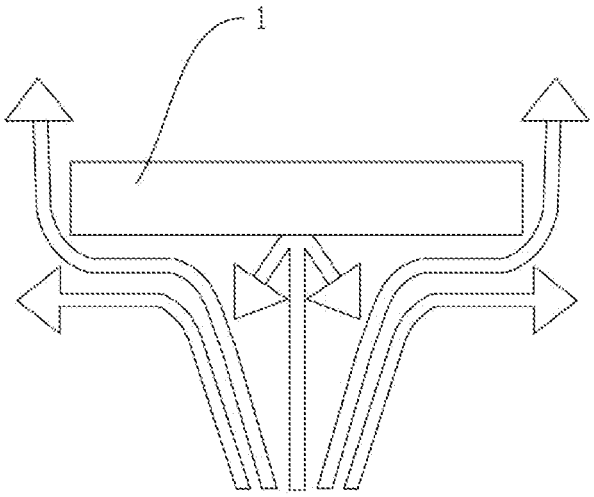
FIG. 7 is a schematic view showing flow directions when an airflow passes around traditional grill bars.

Referring to FIG. 7, FIG. 7 is a schematic view showing flow directions when an airflow passes around traditional grill bars 1. For a traditional planar windward face, the flow direction of the airflow is perpendicular to the windward face, and the grill bar 1 is subject to a large impact, which means the resistance of the airflow is large, resulting in a reduced flow rate of the airflow and a low efficiency of air purification. In addition, the airflow is prone to turbulence and vibration, and generates a large noise. Therefore, the traditional planar windward face cannot reduce the air-outlet resistance, improve the efficiency of air purification, and reduce the noise while guaranteeing the safety performance of the air purifier (requiring small or narrow air openings).

Figure 8:
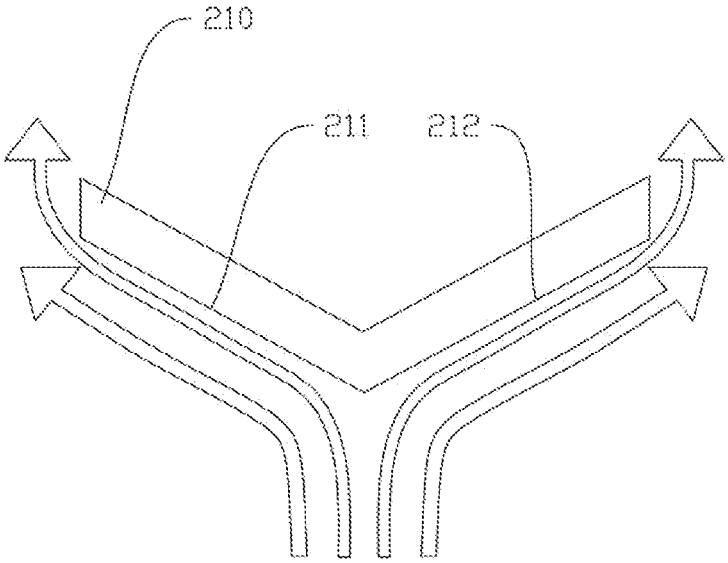
FIG. 8 is a schematic view showing flow directions when an airflow passes around grill bars of the grill in FIG. 1.

Referring to FIG. 8, which is a schematic view showing flow directions when the airflow passes around the grill bar 210 of the grill in FIG. 1. The windward face of the grill bar 210 is divided into a first guide surface 211 and a second guide surface 212. The first guide surface 211 and the second guide surface 212 are obliquely disposed, so that the airflow can be well guided. In particular, when the air comes into contact with the grill bar 210, the airflow, which is in a vertical direction from bottom to top, is changed to flow closely against the first guide surface 211 and the second guide surface 212 to obliquely flow towards two sides, and finally flows out from the air opening 220. In the whole air-outlet process, there is a small change in the flow direction of the airflow, the resistance of the airflow is small, and the air-outlet efficiency is high. Besides, the airflow is well guided by the windward face such that the airflow is not prone to turbulence and the noise generated by the airflow is low.

In other embodiments, the first guide surface 211 and the second guide surface 212 may also be raised cambered surfaces which can also function to guide the airflow. In this case, the first and second intersecting lines are both arcs, the included angle $\alpha$ is defined between a tangent line of the first intersecting line and the reference plane, and the included angle $\beta$ is defined between a tangent line of the second intersecting line and the reference plane.

In other embodiments, the cross section (e.g. the A-A section in FIG. 3) of the grill bar 210 is streamlined, that is, from bottom to top, the grill bar 210 has a cross-sectional area firstly increasing and then decreasing, and upper and lower ends of the grill bar 210 are in an arc protruding shape. The streamlined grill bar 210 may guide the airflow well. When the airflow flows around the grill bar 210, a vortex action can be reduced or the formation of vortex can be avoided, thereby reducing the resistance of the airflow and improving the efficiency of air purification. In this case, the first guide surface 211 and the second guide surface 212 are both curved surfaces, the first and second intersecting lines are both curves, the included angle $\alpha$ is defined between a tangent line of the first intersecting line and the reference plane, and the included angle $\beta$ is defined between a tangent line of the second intersecting line and the reference plane.

In this embodiment, referring to FIG. 3, the air opening 220 has a width of W, which is within the range of $1\ mm \leq W \leq 4\ mm$, and the specific value of W may be 1 mm, 2 mm, 2.5 mm, 3 mm, or 4 mm. The air opening 220 has a small inner end and a large outer end with an overall width defined between 1 mm to 4 mm. The range of W is the minimum size of the air opening 220, which can effectively block most debris from passing through the air opening 220. The injection molding of the smaller air opening 220 is difficult and costly. In addition, in order to narrow the air opening 220, the grill bars 210 need to be widened, which will lead to a large contact area between the grill bars 210 and the airflow and a large air-outlet resistance. The range of W is selected to balance the production and the safety performance of the grill, which is conducive to large-scale production.

Referring to FIG. 5, in this embodiment, the leeward face of the grill bar 210 has a shape corresponding to that of the windward face, that is, the leeward face of the grill bar 210 is concave in the middle and gradually rises or slopes outward and away from the middle of the grill bar and towards the two sides in the direction of airflow around the grill bar. The leeward face of the grill bar 210 includes a first plane 214 and a second plane 213. One side of the first plane 214 is connected to one side of the second plane 213, a joint between the first plane 214 and the second plane 213 is a recess of the leeward face of the grill bar 210, the first plane 214 is parallel to the first guide surface 211, and the second plane 213 is parallel to the second guide surface 212. Therefore, the thickness of the grill bar 210 is relatively uniform, the strength of each part of the grill bar 210 is consistent, and the production material can be saved at the same time. In addition, users can observe the leeward face of the grill bar 210, and the recessed leeward face is more visually rich, optimizing the user experience.

Figure 6:
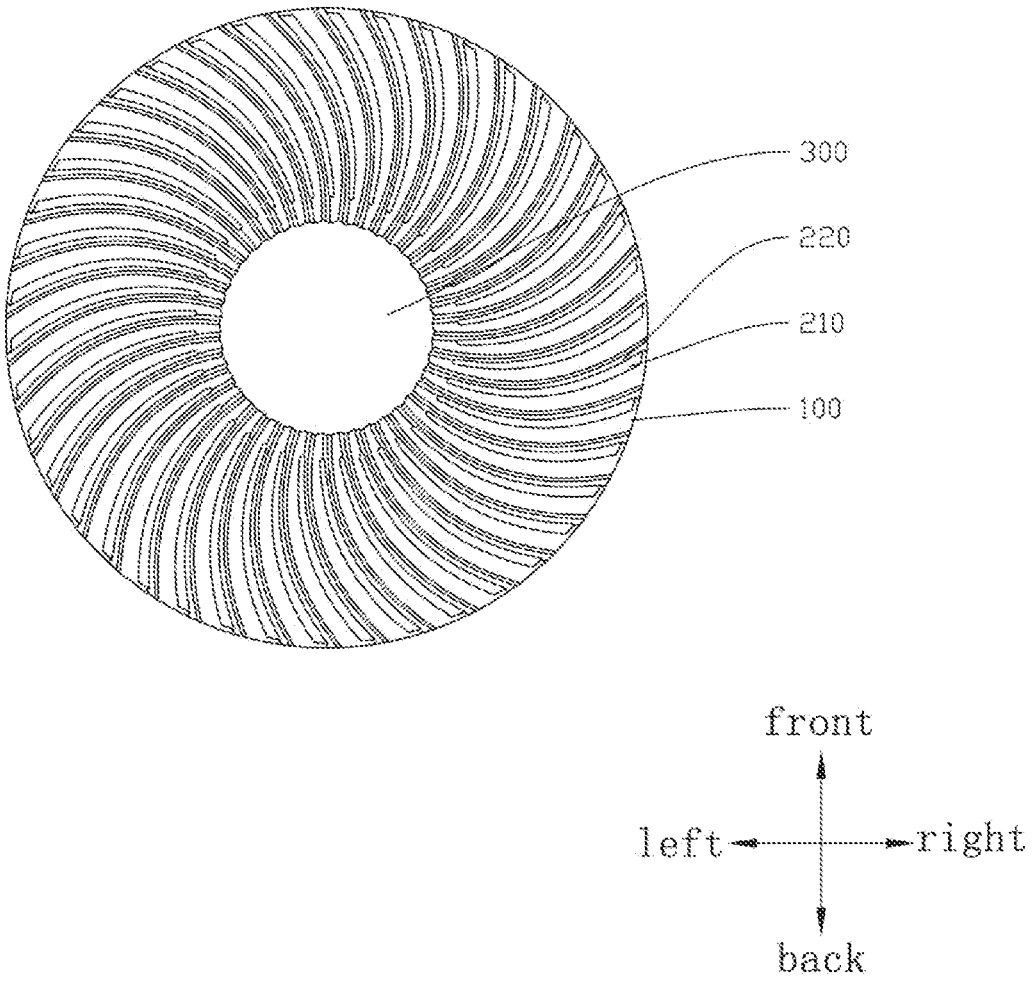
FIG. 6 is a bottom view of the grill in FIG. 1.

Referring to FIG. 2 and FIG. 6 together, FIG. 6 is a bottom view of the grill in FIG. 1. In the related technologies, a fan, generally a centrifugal fan, is mounted inside the air purifier. An outer cover of the centrifugal fan is provided with a volute, and the volute is provided with an air outlet facing the grill. When the centrifugal fan rotates at a high speed, there will be an airflow with a centrifugal effect. The airflow is discharged from the air outlet of the volute after flow concentration by the volute. After being discharged through the air outlet of the volute, most of the airflow moves in a direction parallel to the axis of the grill, and some of the airflow diffuses radially outward along the grill. Therefore, if the grill bar 210 is of a straight strip structure, the radially diffusing airflow may be subjected to the resistance of the grill bar 210, thus causing a loss of air volume. Moreover, the airflow moving radially may collide with ribs, which may increase the noise of the air purifier.

In this embodiment, the grill bar 210 gradually bends or curves in a circumferential direction of the outer positioning frame 100. In particular, the grill bar 210 gradually bends or curves from the inner end to the outer end in a counter-clockwise direction (viewed vertically to the paper). An extending direction of the grill bar 210 is the same as that of the airflow diffusing radially outward along the grill, and the wind resistance is reduced. Thus, the loss of air volume can be reduced, and the airflow will not collide with the ribs, thus reducing the noise of the air purifier.

Referring to FIG. 2, to further reduce the noise, in some embodiments, the grill bar 210 is of a structure that gradually rises and slopes outward and away from a center of the grill in the air-outlet direction (i.e. the direction from bottom to top), and correspondingly, the shape of the air openings 220 corresponds to the shape of the grill bars 210 between which they extend from from the center of the grill outward and in the air-outlet direction. Thus, the whole grill has a flared shape with a small bottom and a big top. When the airflow passes through the air opening 220 from bottom to top, the time for each portion of the airflow to pass through the air opening 220 is different (the portion of airflow near the inner end of the grill bar 210 passes through the air opening 220 sooner). Thus, a time difference of the airflow leaving the air opening 220 can be used to reduce pulsation of the airflow, thereby effectively reducing the wind noise.

Referring to FIG. 3, to cooperate with the fan to blow out air, the grill body 200 is designed to be ring-shaped, and covers the air-outlet area of the fan, so as to maximize the air-outlet rate.

Figure 9:
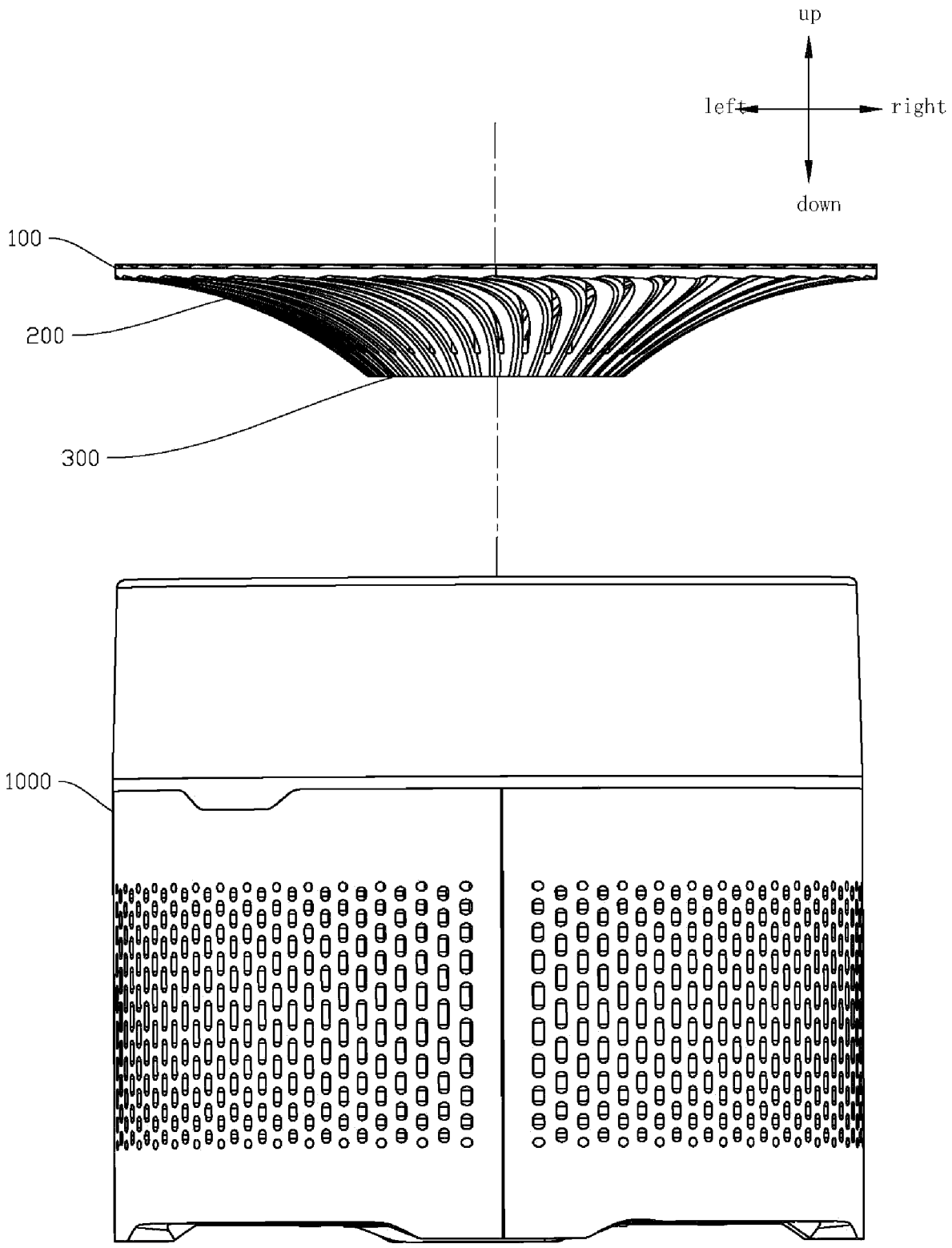
FIG. 9 is an exploded view of an air purifier according to an embodiment of the present disclosure, which includes the grill shown in FIG. 2.
Figure 10:
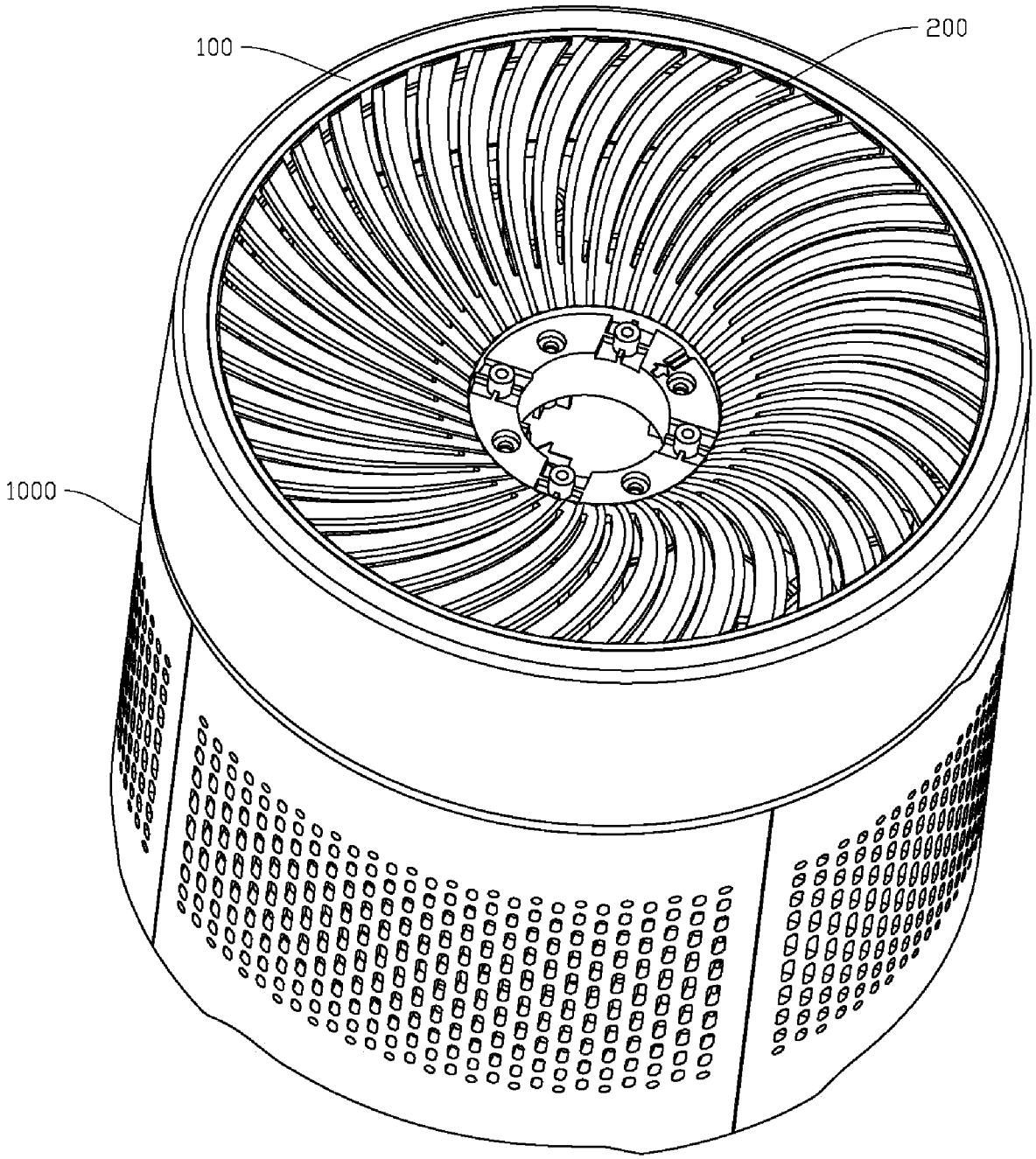
FIG. 10 is a schematic view of an air purifier according to an embodiment of the present invention, the grill shown in FIG. 2 has been assembled to the air purifier.

The present disclosure further relates to an air purifier 1000, including the above grill which is mounted at an air outlet of the air purifier. The air purifier 1000 is shown in FIG. 9 and FIG. 10. With the use of the above grill, the air-outlet resistance can be reduced, the efficiency of air purification can be improved, and the noise can be reduced while small air holes are ensured, which is conducive to the improvement of user experience.

In other embodiments, the grill may also be mounted to an air inlet of the air purifier, which can also reduce the air-inlet resistance, improve the air-inlet efficiency, and reduce air-inlet noise.

The embodiments of the present disclosure are described above in detail with reference to the accompanying drawings, but the present disclosure is not limited to the above embodiments. Within the scope of knowledge possessed by a person of ordinary skill in the art, various modifications can be further made without departing from the purpose of the present disclosure. In addition, the embodiments of the present disclosure and features in the embodiments may be combined with each other without a conflict.

What is claimed is:

1. A grill body, comprising a plurality of grill bars, with an air opening between two adjacent grill bars, wherein each of the grill bars comprises a windward face configured to be convex in a middle of each grill bar and gradually slope away from the middle of each grill bar towards two sides of each grill bar and in a direction of airflow past each grill bar;

wherein the windward face of each grill bar comprises a first guide surface and a second guide surface, one side of the first guide surface is connected to one side of the second guide surface, for any axis of the air opening, a plane perpendicular to the axis is defined as a reference plane, an intersecting line between a cross section of each grill bar passing through the axis and the first guide surface is defined as a first intersecting line, an intersecting line between the cross section of each grill bar passing through the axis and the second guide surface is defined as a second intersecting line, an included angle between the first intersecting line and the reference plane is 8° to 15°, and an included angle between the second intersecting line and the reference plane is 15° to 85°.

2. The grill body of claim 1, wherein both the first guide surface and the second guide surface are planar.

3. The grill body of claim 1, wherein each grill bar has a streamlined cross section.

4. The grill body of claim 1, wherein each grill bar comprises a leeward face configured to be concave in the middle of each grill bar and gradually slope away from the middle of each grill bar towards the two sides of each grill bar and in the direction of airflow past each grill bar.

5. The grill body of claim 1, wherein the air opening has a width of 1 mm to 4 mm.

6. A grill, comprising the grill body of claim 1, and further comprising an inner positioning member and an outer positioning frame, one end of the grill bar being fixedly connected to the inner positioning member, the other end of the grill bar being fixedly connected to the outer positioning frame, and the plurality of grill bars being radially distributed.

7. The grill of claim 6, wherein both the first guide surface and the second guide surface are planar.

8. The grill of claim 6, wherein each grill bar has a streamlined cross section.

9. The grill of claim 6, wherein each grill bar comprises a leeward face configured to be concave in the middle of each grill bar and gradually slope away from the middle of each grill bar towards the two sides of each grill bar and in the direction of airflow past each grill bar.

10. The grill of claim 6, wherein the air opening has a width of 1 mm to 4 mm.

11. The grill of claim 6, wherein each grill bar is configured to gradually bend in a circumferential direction of the outer positioning frame.

12. The grill of claim 6, wherein each grill bar is configured to gradually slope outward and away from a center of the grill in the direction of airflow past each grill bar.

13. An air purifier, comprising the grill of claim 6, the grill being disposed at an air outlet and/or an air inlet of the air purifier.

* * * * *